US007074247B2

(12) United States Patent
Tank et al.

(10) Patent No.: US 7,074,247 B2
(45) Date of Patent: Jul. 11, 2006

(54) METHOD OF MAKING A COMPOSITE ABRASIVE COMPACT

(76) Inventors: Klaus Tank, 9 Warbleton Avenue, Essexwold, Johannesburg (ZA) 2001; Moosa Mahomed Adia, 8 Nagel Street, Lakefield, Benoni (ZA) 1501; Roy Derrick Achilles, 608 San Martinho, Leicester Road, Bedfordview (ZA) 2007; Paul Machael Daniel, 11 Granby Road, Selcourt, Springs (ZA) 1559

( * ) Notice: Subject to any disclaimer, the term of this patent is extended or adjusted under 35 U.S.C. 154(b) by 461 days.

(21) Appl. No.: 10/399,471

(22) PCT Filed: Oct. 15, 2001

(86) PCT No.: PCT/IB01/01922

§ 371 (c)(1),
(2), (4) Date: Aug. 25, 2003

(87) PCT Pub. No.: WO02/34437

PCT Pub. Date: May 2, 2002

(65) Prior Publication Data

US 2004/0037948 A1 Feb. 26, 2004

(30) Foreign Application Priority Data

Oct. 19, 2000 (ZA) ..... 2000/5827
Nov. 16, 2000 (ZA) ..... 2000/6677

(51) Int. Cl.
*B24D 18/00* (2006.01)
*C22C 29/02* (2006.01)
*B22F 7/06* (2006.01)

(52) U.S. Cl. ..... 51/293; 51/307; 51/295; 419/5; 419/11; 419/13; 419/14; 419/18; 419/23; 419/38; 419/48; 419/49; 264/642

(58) Field of Classification Search ..... 51/307, 51/293, 295; 419/5, 11, 13, 14, 18, 23, 38, 419/48, 49; 264/642
See application file for complete search history.

(56) References Cited

U.S. PATENT DOCUMENTS

| | | | | | |
|---|---|---|---|---|---|
| 4,247,304 | A | * | 1/1981 | Morelock | 51/295 |
| 5,468,268 | A | * | 11/1995 | Tank et al. | 51/293 |
| 5,505,748 | A | * | 4/1996 | Tank et al. | 51/293 |
| 5,766,394 | A | * | 6/1998 | Anderson et al. | 156/89.11 |
| 6,132,675 | A | * | 10/2000 | Corrigan et al. | 419/11 |

FOREIGN PATENT DOCUMENTS

| | | |
|---|---|---|
| EP | 0 626 236 | 11/1994 |
| WO | 00 38864 | 7/2000 |

* cited by examiner

*Primary Examiner*—Michael A. Marcheschi
(74) *Attorney, Agent, or Firm*—Oblon, Spivak, McClelland, Maier & Neustadt, P.C.

(57) ABSTRACT

There is provided a method of making a composite abrasive compact which comprises an abrasive compact bonded to a substrate. The abrasive compact will generally be a diamond compact and the substrate will generally be a cemented carbide substrate. The composite abrasive compact is made under known conditions of elevated temperature and pressure suitable for producing abrasive compacts. The method is characterised by the mass of abrasive particles from which the abrasive compact is made. This mass has three regions which are: (i) an inner region, adjacent the surface of the substrate on which the mass is provided, containing particles having at least four different average particle sizes; (ii) an outer region containing particles having at least three different average particle sizes; and (iii) an intermediate region between the first and second regions.

16 Claims, 2 Drawing Sheets

METHOD OF MAKING A COMPOSITE ABRASIVE COMPACT

BACKGROUND OF THE INVENTION

This invention relates to a method of making a composite abrasive compact.

Abrasive compacts are used extensively in cutting, milling, grinding, drilling, boring and other abrasive operations. Abrasive compacts consist of a mass of diamond or cubic boron nitride particles bonded into a coherent, polycrystalline conglomerate. The abrasive particle content of abrasive compacts is high and there is generally an extensive amount of direct particle-to-particle bonding. Abrasive compacts are made under elevated temperature and pressure conditions at which the abrasive particle, be it diamond or cubic boron nitride, is crystallographically stable.

Diamond abrasive compacts are also known as polycrystalline diamond or PCD and cubic boron nitride abrasive compacts are also known as polycrystalline CBN or PCBN.

Abrasive compacts tend to be brittle and in use they are frequently supported by being bonded to a cemented carbide substrate or support. Such supported abrasive compacts are known in the art as composite abrasive compacts. Composite abrasive compacts may be used as such in a working surface of an abrasive tool.

In making abrasive compacts, particles of a single size or a mixture of particles of various sizes may be used. Examples of such compacts are disclosed in U.S. Pat. Nos. 4,604,106 and 5,011,514.

It is also known to produce an abrasive compact which has two zones differing in particle size. Examples of such compacts are described in U.S. Pat. Nos. 4,861,350 and 4,311,490.

European Patent No. 0 626 236 describes a method of making an abrasive compact which includes the step of subjecting a mass of ultra-hard abrasive particles to conditions of elevated temperature and pressure suitable for producing an abrasive compact, the mass being characterised by at least 25% by mass of ultra-hard abrasive particles having an average particles size in the range 10 to 100 microns and consisting of particles having at least three different particle sizes and at least 4% by mass of ultra-hard abrasive particles having an average particles size of less then 10 microns. The particle mix thus contains four different sizes of particles. The specification discloses the advantages of using such a mixture of particles in producing abrasive compacts in turning and shaper tests.

European Patent No. 0 626 237 discloses a method of making an abrasive compact which includes the step of subjecting a mass of ultra-hard abrasive particles to conditions of elevated temperature and pressure suitable for producing an abrasive compact, the mass being characterised by the ultra-hard abrasive particles having an average particle size of less than 20 microns and consisting of particles having three different average particle sizes.

Composite abrasive compacts of the type described above are used in a variety of applications. One such application is as an insert for drill bits. Such bits including percussion bits, rolling cone bits and drag bits. For drill bits, the diamond compact layer is generally fairly thick, e.g. having a thickness of up to 5 mm. In the manufacture of composite diamond compacts, stresses arise in the diamond compact layer. These stresses are caused, in part, by a difference in the thermal coefficient of expansion between the diamond layer and the substrate. Such stresses give rise to several problems. For example delamination of the diamond layer from the substrate can occur when the composite diamond compact is brazed to a working surface of a tool. Further, the stresses in the diamond layer can lead to spalling or chipping of the diamond layer, in use.

SUMMARY OF THE INVENTION

According to the present invention, a method of making a composite abrasive compact comprising an abrasive compact bonded to a substrate, generally a cemented carbide substrate, includes the steps of providing a mass of ultra-hard abrasive particles on a surface of a substrate to form an unbonded assembly and subjecting the unbonded assembly to conditions of elevated temperature and pressure suitable for producing an abrasive compact, the mass of ultra-hard abrasive particles being characterised by three regions:

(i) an inner region, adjacent the surface of the substrate on which the mass is provided, containing particles having at least four different average particle sizes;

(ii) an outer region containing particles having at least three different average particle sizes; and (iii) an intermediate region between the first and second regions.

The method of the invention utilises a mass of ultra-hard abrasive particles which has at least three regions, the inner and outer regions differing from each other in their particle size composition. The particles of the inner region will generally be coarser than the particles of the outer region.

The particles present in the inner region, which generally have a size up to 100 microns. The particles in the outer region will generally have a size of up to 25 microns.

The inner region contains particles having at least four different average particle sizes. It has been found particularly suitable for this region to comprise a mass containing six different average particle sizes.

The outer region contains particles having at least three different average particle sizes, the particles all generally being fine. This region thus provides the compact produced with a tough, wear-resistant and abrasive region.

The intermediate region may comprise more than one region or layer, each region or layer differing in particle size composition from the others.

The intermediate region will generally be in contact with both the outer region and the inner region.

The regions will generally be defined as layers.

The surface of the substrate on which the particulate mass is provided may be planar, curved, or profiled.

DESCRIPTION OF EMBODIMENTS

Figure 1:
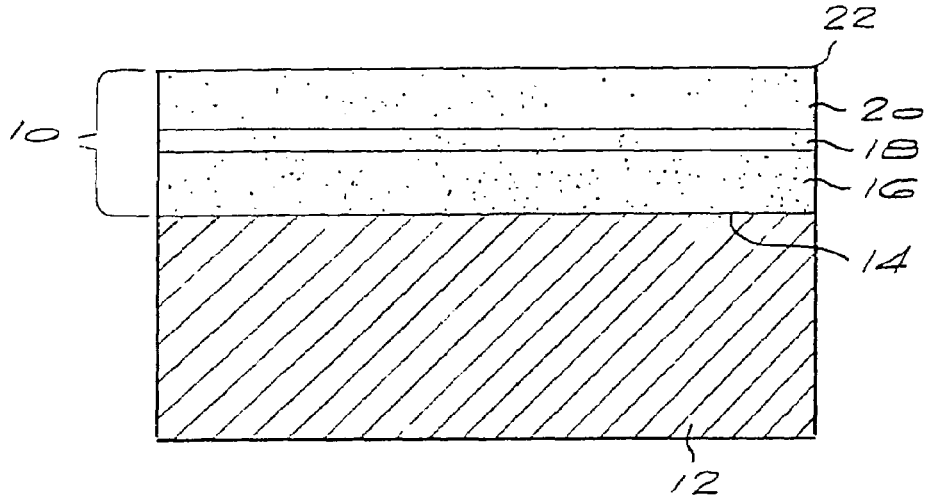
FIGS. 1 to 5 are sectional side views of five different embodiments of unbonded assemblies for use in the method of the invention.

The ultra-hard abrasive particles may be diamond or cubic boron nitride, and are preferably diamond particles. The diamond may be natural or synthetic or a mixture thereof.

The ultra-hard abrasive particle mass will be subjected to known temperature and pressure conditions necessary to produce an abrasive compact. These conditions are typically those required to synthesise the abrasive particles themselves. Generally the pressures used will be in the range 4 to 7 GPa and the temperature used will be in the range 1300° C. to 1600° C. During production of the abrasive compact, bonding of the compact to the substrate occurs.

The abrasive compact which is produced by the method of the invention will generally and preferably have a binder present. The binder will preferably be a solvent/catalyst for the ultra-hard abrasive particle used. Solvents/catalysts for diamond and cubic boron nitride are well known in the art. In the case of diamond, the binder is preferably cobalt, iron, nickel or an alloy containing one or more of these metals.

When a binder is used, particularly in the case of diamond compacts, it may be caused to infiltrate the mass of abrasive particles during compact manufacture. A shim or layer of the binder may be used for this purpose. This shim or layer may be placed on a surface of the substrate and the mass of ultra-hard abrasive particles placed on the shim or layer. Alternatively, and preferably, the binder is in particulate form and is mixed with the mass of abrasive particles. The binder will typically be present in an amount of 2 to 25% by mass of the abrasive compact produced.

The substrate is preferably a cemented carbide substrate such as cemented tungsten carbide, cemented tantalum carbide, cemented titanium carbide, cemented molybdenum carbide or a mixture thereof. The binder metal for such carbide may be any known in the art such as nickel, cobalt, iron or an alloy containing one or more of these metals. Typically this binder will be present in an amount of 10 to 20% by mass, but the binder may be present in an amount as low as 6% by mass. Some of the binder metal may infiltrate the abrasive compact during compact formation.

The method of the invention is characterised by the use of three different regions of abrasive particles in the abrasive particle mass which is used to produce the compact. These regions, or at least the inner and outer regions, will be discernible in the sintered compact under magnification.

The inner and outer regions contain particles differing from each other in their composition of particles sizes. The intermediate region will also preferably contain such a mixture of particles. By the term "average particle size" is meant that a major amount of the particles will be close to the specified size although there will be some particles above and some particles below the specified size. The peak in the distribution of particles will have a specified size. Thus, for example, if the average particle size is 10 microns, there will be some particles which are larger and some particles which are smaller than 10 microns, but the major amount of the particles will be at approximately 10 microns in size and a peak in the distribution of particles will be 10 microns.

The inner region contains particles having at least four different average particle sizes. Preferably, in this region, (i) the majority of particles will have an average particle size in the range 10 to 100 microns and consist of at least three different average particle sizes and (ii) at least 4% by mass of particles will have an average particle size of less than 10 microns.

The particles (i) will preferably have the following composition:

| Average Particle Size (in microns) | Percent by mass |
|---|---|
| Greater than 40 | at least 30 |
| 20 to 35 | at least 25 |
| 10 to 15 | at least 10 |

An example of a particularly useful particle composition for the inner region is:

| Average Particle Size (in microns) | Percent by mass |
|---|---|
| 75 | 15 |
| 45 | 40 |
| 30 | 15 |
| 22 | 15 |
| 10 | 10 |
| 4 | 5 |

It has been found that a particle mix for the inner region containing at least four different particle sizes provides an excellent bonding region for the compact and the substrate. Strong bonding to the substrate is achieved and mis-match stresses which can build up are minimised. The thickness of this region, in the sintered abrasive compact, will typically be 0.5 to 3 mm.

The outer region is the region which provides the sintered abrasive compact with the cutting surface or edge. The abrasive particle mass for this region is characterised by containing at least three different particle sizes. Preferably the particles of this region will have an average particle size not exceeding 25 microns.

An example of a composition for the abrasive particles of this mix is:

| Average Particle Size (in microns) | Percent by mass |
|---|---|
| At least 10 | at least 20 |
| Less than 10 and 5 or greater | at least 15 |
| Less than 5 | at least 15 |

Examples of specific compositions which are useful for the outer region are:

Composition 1

| Average Particle Size (in microns) | Percent by mass |
|---|---|
| 12 | 25 |
| 8 | 25 |
| 4 | 50 |

Composition 2

| Average Particle Size (in microns) | Percent by mass |
|---|---|
| 22 | 28 |
| 12 | 44 |
| 6 | 7 |
| 4 | 16 |
| 2 | 5 |

The outer region in the sintered abrasive compact will typically have a thickness of 0.5 to 3 mm.

The intermediate region will preferably contain a mixture of abrasive particles differing in average particle size. That mixture typically contains at least two different average particle sizes and preferably contains four different average particle sizes. An example of a suitable composition for the intermediate layer is:

| Average Particle Size (in microns) | Percent by mass |
|---|---|
| 30 | 65 |
| 22 | 20 |
| 12 | 10 |
| 4 | 5 |

The intermediate region may itself contain more than one region or layer. For example the intermediate region may comprise three layers each differing in average particle size.

The intermediate region, or each layer or region thereof, will generally be thin and have a thickness typically less than 0.3 mm in the sintered abrasive compact. The region may merge with the inner and outer regions during compact manufacture, or may remain, in the sintered compact, as a distinct layer.

When the intermediate region comprises more than one region or layer, the layer in contact with the inner region will typically have a composition as identified the second layer, on the first layer, will typically have a composition of:

| Average Particle Size (in microns) | Percent by mass |
|---|---|
| 22 | 50 |
| 12 | 30 |
| 4 | 16 |
| 2 | 4 |

The substrate surface on which the abrasive particle mass is placed may be planar, curved or otherwise profiled. The invention has particular application to producing composite abrasive compacts which have a profiled interface between the substrate and the abrasive compact of the type illustrated described in European Patent Publication No. 0 941 791.

Embodiments of the invention will now be described with reference to FIGS. 1 to 5. Referring first to FIG. 1, an unbonded assembly suitable for producing a composite abrasive compact comprises a layer of abrasive particles 10 placed on a surface 14 of a cemented carbide substrate 12.

The layer 10 comprises three regions—an inner region 16, an intermediate region 18 and an outer region 20. The regions differ in their particle size composition, as described above. The unbonded assembly is placed in the reaction zone of a conventional high temperature/high pressure apparatus and subjected to appropriate high temperature/high pressure sintering conditions. The product which is produced is a diamond compact layer 10 bonded to a substrate 12 along interface 14. The diamond compact layer will have the three regions or layers 16, 18 and 20. The peripheral edge 22 of the compact layer 10 as produced provides the cutting edge of the compact.

Figure 2:
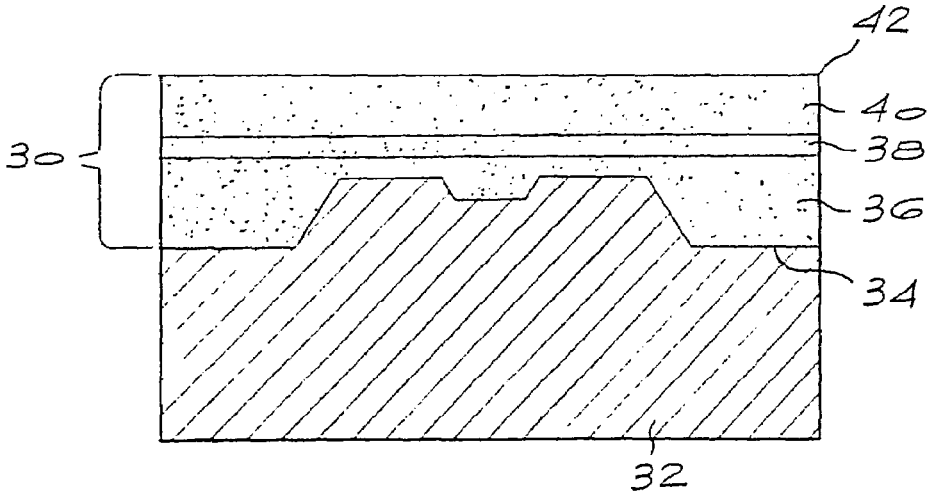

A second embodiment is illustrated by FIG. 2. Referring to this figure, an abrasive particle layer 30 is placed on a surface 34 of a cemented carbide substrate 32. Surface 34 is profiled. The abrasive particle layer 30 has three regions—an inner region 36, an intermediate region 38 and an outer region 40. These regions differ in their particle size composition, as described above. The composite abrasive compact which is produced from the unbonded assembly of FIG. 2 will have essentially the same structure, i.e. and abrasive compact layer 30 bonded to substrate 32 along interface 34. The peripheral edge 42 of the abrasive compact layer provides the cutting edge for the compact.

Figure 3:
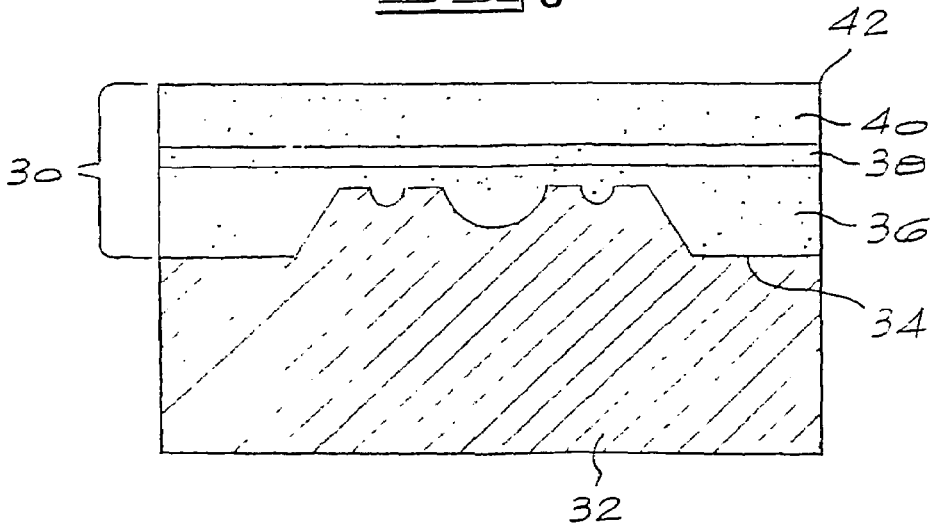

The embodiment of FIG. 3 is the same as that of FIG. 2, save that the surface 34 has a different profile. Like parts in FIG. 3 carry the same numerals as that for FIG. 2.

Figure 4:
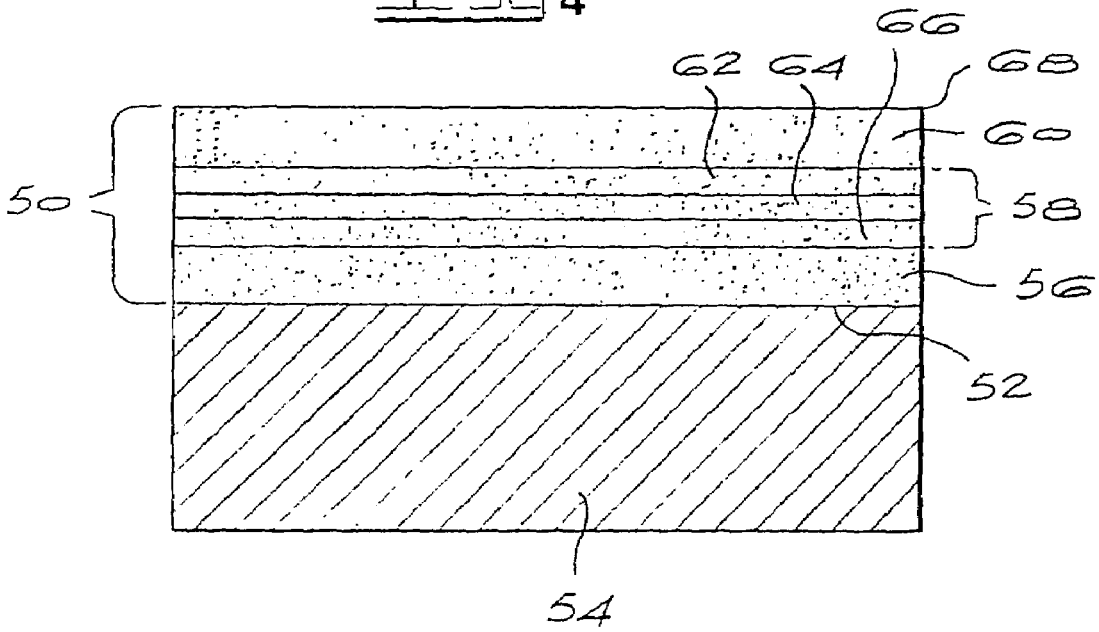

A further embodiment is illustrated by FIG. 4. Referring to this figure, an abrasive particle layer 50 is place on a surface 52 of a cemented carbide substrate 54. The abrasive particle layer 50 has three regions,—an inner region 56 and an intermediate region 58 and an outer region 60. The inner region 56 and the outer region 60 have particle size compositions as described above. The intermediate region, in contrast to the other illustrated embodiments, consists of three separate and contacting layers 62, 64 and 66. Particle size compositions of each of these layers will differ from each other. The composite abrasive compact which is produced from the unbonded assembly of FIG. 4 is one which has an abrasive compact layer 50 bonded to a cemented carbide substrate 54 along interface 52. The peripheral edge 68 of the abrasive compact layer provides the cutting edge for the compact.

In the embodiments described above, the cutting edges may be provided with a chamfer, radius or edge otherwise broken.

Figure 5:
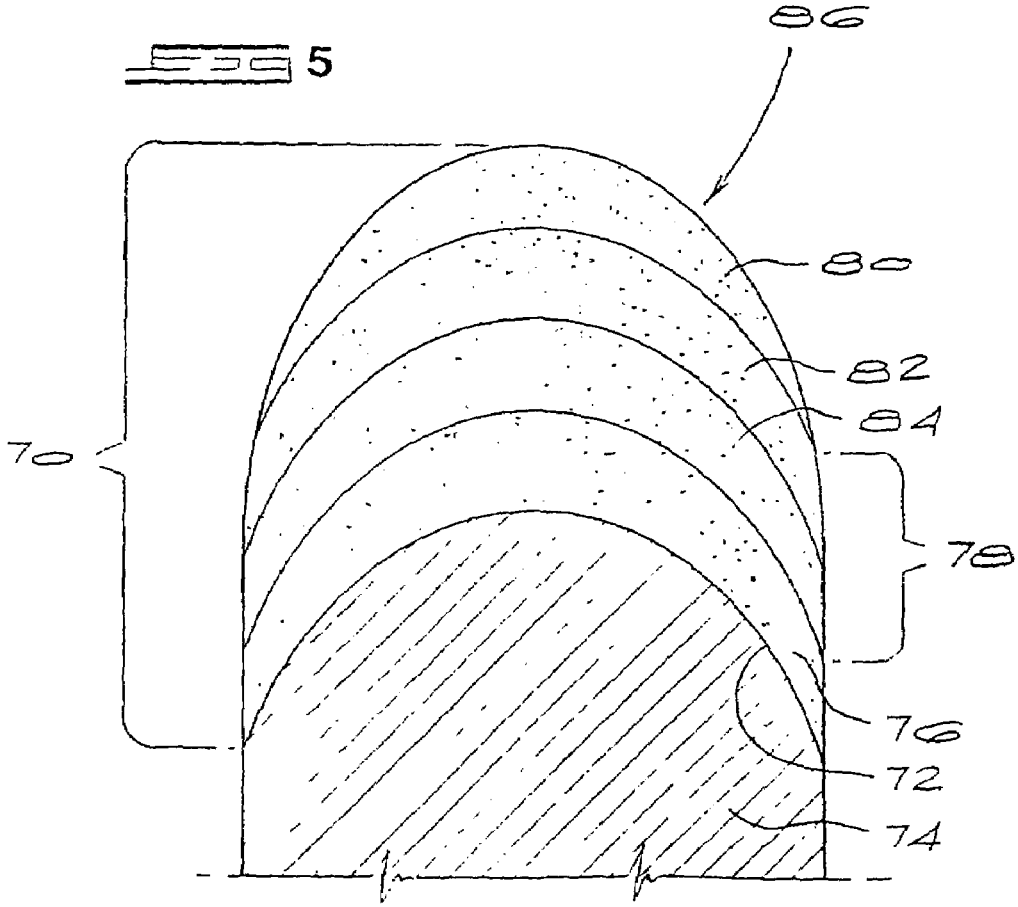

Yet another embodiment of the invention is illustrated by FIG. 5. Referring to this figure, the abrasive particle layer 70 is placed on a curved upper surface 72 of a cemented carbide substrate 74. The abrasive particle layer 70 comprises an inner region 76, an intermediate region 78 and an outer region 80. The inner region 76 and the outer region 80 have particle compositions as described above. The intermediate region 78 comprises two layers 82 and 84 the compositions of which may be of the type described above for an intermediate region comprising two layers. The composite abrasive compact produced from the unbonded assembly illustrated by FIG. 5 comprises a diamond compact layer 70 bonded to a cemented carbide substrate 74 along an interface 72. The composite abrasive compact has bullet shape and it is the curved outer surface 86 of the abrasive compact layer which provides a cutting surface for the compact.

The composite abrasive compact produced by the method of the invention has a wide range of applications such as drilling, cutting, milling, grinding, boring and other abrasive operations. More particularly, the composite abrasive compact has application as an insert for percussion drills, rolling cone bits and drag bits. In such applications it is desirable to have as thick a compact layer as possible. Using regions of different particle size compositions, as described above, in the manufacture of such compacts reduces significantly the tendency for such composite abrasive compacts to spall, delaminate or otherwise fail due to internal stresses created in the compact layer during manufacture. The intermediate region, whether one or more layers, and the use of multi-modal material, i.e. different particle sizes in the various regions, minimises the residual stresses within the compact thus ensuring high toughness of the compact.

The invention claimed is:

1. A method of making a composite abrasive compact comprising an abrasive compact bonded to a substrate including the steps of providing a mass of ultra-hard abrasive particles on a surface of a substrate to form an unbonded assembly and subjecting the unbonded assembly to conditions of elevated temperature and pressure suitable for producing an abrasive compact, the mass of ultra-hard abrasive particles being characterised by three regions:

(i) an inner region, adjacent the surface of the substrate on which the mass is provided, containing particles having at least four different average particle sizes;

(ii) an outer region containing particles having at least three different average particle sizes; and (iii) an intermediate region between the first and second regions.

2. A method according to claim 1 wherein the particles of the inner region are coarser than the particles in the outer region.

3. A method according to claim 1 wherein the particles in the inner region have a size up to 100 microns.

4. A method according to claim 1 wherein the particles in the outer region have a size up to 25 microns.

5. A method according to claim 1 wherein the intermediate region comprises more than one region or layer, each region or layer differing in particle size composition from the others.

6. A method according to claim 1 wherein the intermediate region is in contact with both the outer region and the inner region.

7. A method according to claim 1 wherein the regions are defined as layers.

8. A method according to claim 1 wherein the surface of the substrate on which the particulate mass is provided is planar, curved or profiled.

9. A method according to claim 1 wherein a shim or layer of a binder for the abrasive compact is provided on a surface of the substrate and a mass of ultra-hard abrasive particles is placed on the shim or layer.

10. A method according to claim 1 wherein a binder for the abrasive compact, in particulate form, is mixed with the mass of ultra-hard abrasive particles.

11. A method according to claim 9 wherein the binder is provided in an amount sufficient to provide the abrasive compact produced with a binder content of 2 to 25% by mass.

12. A method according to claim 1 wherein the substrate is a cemented carbide substrate.

13. A method according to claim 1 wherein the conditions of elevated temperature and pressure are a pressure in the range 4 to 7 GPa and a temperature in the range 1300° C. to 1600° C.

14. A method according to claim 1 wherein the particle size composition of the inner region is:

(i) the majority of particles have an average particle size in the range 10 to 100 microns and consist of at least three different average particle sizes; and (ii) at least 4% by mass of the particles have an average particle size of less than 10 microns.

15. A method according to claims 1, wherein the particle size composition of the inner region is:

| Average Particle Size (in microns) | Percent by mass |
|---|---|
| Greater than 40 | at least 30 |
| 20 to 35 | at least 25 |
| 10 to 15 | at least 10 |

16. A method according to claim 1 wherein the particle size composition of the outer region is:

| Average Particle Size (in microns) | Percent by mass |
|---|---|
| At least 10 | at least 20 |
| Less than 10 and 5 or greater | at least 15 |
| Less than 5 | at least 15 |

* * * * *